US008965239B2

(12) United States Patent
Kaino et al.

(10) Patent No.: US 8,965,239 B2
(45) Date of Patent: Feb. 24, 2015

(54) HEAT FIXING DEVICE HAVING COOLING FAN AND PRESSING ROLLER WITH HEAT CONDUCTIVE FILLER

(75) Inventors: Toshiya Kaino, Suntou-gun (JP); Satoru Izawa, Suntou-gun (JP); Koji Nihonyanagi, Susono (JP); Kuniaki Kasuga, Mishima (JP); Taisuke Minagawa, Mishima (JP); Hayato Negishi, Chichibu-gun (JP); Jun Asami, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 91 days.

(21) Appl. No.: 13/540,382

(22) Filed: Jul. 2, 2012

(65) Prior Publication Data

US 2013/0011157 A1 Jan. 10, 2013

(30) Foreign Application Priority Data

Jul. 7, 2011 (JP) ..... 2011-150906

(51) Int. Cl.
*G03G 21/20* (2006.01)
*G03G 15/20* (2006.01)

(52) U.S. Cl.
CPC ..... *G03G 15/206* (2013.01); *G03G 15/2017* (2013.01)
USPC ..... 399/92

(58) Field of Classification Search
CPC .. G03G 15/206; G03G 15/2017; G03G 21/20
USPC ..... 399/92, 333, 69, 406
See application file for complete search history.

(56) References Cited

U.S. PATENT DOCUMENTS

| | | | | |
|---|---|---|---|---|
| 2005/0238380 | A1* | 10/2005 | Iijima et al. | 399/92 |
| 2007/0280721 | A1* | 12/2007 | Kanai | 399/92 |
| 2008/0013981 | A1* | 1/2008 | Kimura et al. | |
| 2008/0070031 | A1* | 3/2008 | Rasch et al. | 399/333 |
| 2009/0003902 | A1* | 1/2009 | Sakakibara et al. | |
| 2009/0116886 | A1* | 5/2009 | Sakai et al. | |
| 2011/0091252 | A1* | 4/2011 | Sekihara et al. | 399/333 |

FOREIGN PATENT DOCUMENTS

| | | | |
|---|---|---|---|
| JP | 01195479 | A * | 8/1989 |
| JP | 04204581 | A * | 7/1992 |
| JP | 10090957 | A * | 4/1998 |
| JP | 2003223067 | A * | 8/2003 |
| JP | 2006267703 | A * | 10/2006 |
| JP | 2007-187816 | A | 7/2007 |
| JP | 2009-288275 | A | 12/2009 |

* cited by examiner

*Primary Examiner* — Susan Lee
(74) *Attorney, Agent, or Firm* — Canon USA Inc IP Division

(57) ABSTRACT

A heat fixing device includes a rotatable member for heating, a pressing roller configured to form a fixing nip portion that nips and conveys a recording material bearing a toner image, and a cooling fan configured to cool a recording material non-passing region in the rotatable member for heating in a direction orthogonal to a recording material conveying direction, wherein the pressing roller includes a rubber layer, between a cored bar and a release layer, containing a needle-shaped heat conductive filler oriented in a roller axis direction.

12 Claims, 14 Drawing Sheets

HEAT FIXING DEVICE HAVING COOLING FAN AND PRESSING ROLLER WITH HEAT CONDUCTIVE FILLER

BACKGROUND OF THE INVENTION

1. Field of the Invention

The present invention relates to a heat fixing device equipped on an image forming apparatus such as an electrophotographic copying machine and an electrophotographic printer.

2. Description of the Related Art

An image forming apparatus such as a copying machine and a printer of an electrophotographic system is equipped with a heat fixing device that fixes a toner image on a recording material. When a toner image is printed on a small-sized recording material, temperature in a region through which the recording material does not pass in the heat fixing device is excessively elevated. As one measure for the temperature to be excessively elevated, a technique in which a cooling fan that cools a paper non-passing region is provided is available.

In Japanese Patent Application Laid-Open No. 2007-187816, a cooling unit (a cooling fan) that cools the paper non-passing region of a heating member is provided to reduce excessive temperature elevation in the paper non-passing region. In this method, it is possible to reduce the excessive temperature elevation by arranging a temperature detection element in the paper non-passing region of the heating member and positively sending a cooled wind in an air volume depending on the detected temperature. This method can also meet recording materials having various widths by changing a cooled region depending on the width of the recording material.

However, this method has a problem in that some wind sent from the cooling fan to the paper non-passing region to be elevated in temperature in the heating member enters the inside of a paper passing region to drop the temperature in edges of the paper passing region in the heating member (temperature drop). In particular, in a printer in which a large number of sheets are printed per unit period of time, the temperature in the paper non-passing region is largely elevated. Thus, it is necessary to increase the air volume of the cooled wind in order to keep the temperature of the heating member equivalent to or lower than an upper temperature limit. However, since the air volume is large, some of the wind also lowers the temperature in the edges of the paper passing region in the heating member. This deteriorates a fixability and causes an uneven gloss in both edges of the small sized recording material. Thus, to maintain the fixability, the air volume in the cooling fan cannot be increased simply.

For this problem, in Japanese Patent Application Laid-Open No. 2009-288275, after driving the cooling fan, an energization ratio of multiple heating devices with different heating distribution is controlled so that a heat volume in a region corresponding to a region cooled by the cooling fan is increased compared with that before being cooled. However, in Japanese Patent Application Laid-Open No. 2009-288275, the heat volume in the region to be cooled is increased, and thus, wasted electricity is consumed. Also when the number of sheets to be printed per unit period of time is further increased, the temperature in the paper non-passing region is further elevated. To deal with this excessive temperature elevation, a cooling fan with high power is required, easily leading to increasing in size of the apparatus.

SUMMARY OF THE INVENTION

An aspect of the present invention is directed to a heat fixing device with reduced waste of electric power, which can strike a good balance between reduction of temperature elevation in a paper non-passing region and acquisition of fixability.

According to an aspect of the present invention, a heat fixing device includes a rotatable member for heating, a pressing roller configured to form a fixing nip portion that nips and conveys a recording material bearing a toner image, and a cooling fan configured to cool a recording material non-passing region in the rotatable member for heating in a direction orthogonal to a recording material conveying direction, wherein the pressing roller includes a rubber layer, between a cored bar and a release layer, containing a needle-shaped heat conductive filler oriented in a roller axis direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EXEMPLARY EMBODIMENTS

Various exemplary embodiments, features, and aspects of the invention will be described in detail below with reference to the drawings.

In the following description, concerning a heat fixing device and members that compose the heat fixing device, a lengthwise direction is a direction orthogonal to a recording material conveying direction (axis direction of pressing roller) on a surface of a recording material. The lengthwise direction is also a direction orthogonal to a rotation direction of a rotatable member for heating described below. A crosswise direction is a direction parallel with the recording material conveying direction on the surface of the recording material. An axis direction concerning the recording material is a direction orthogonal to the recording material conveying direction on the surface of the recording material.

Figure 1:
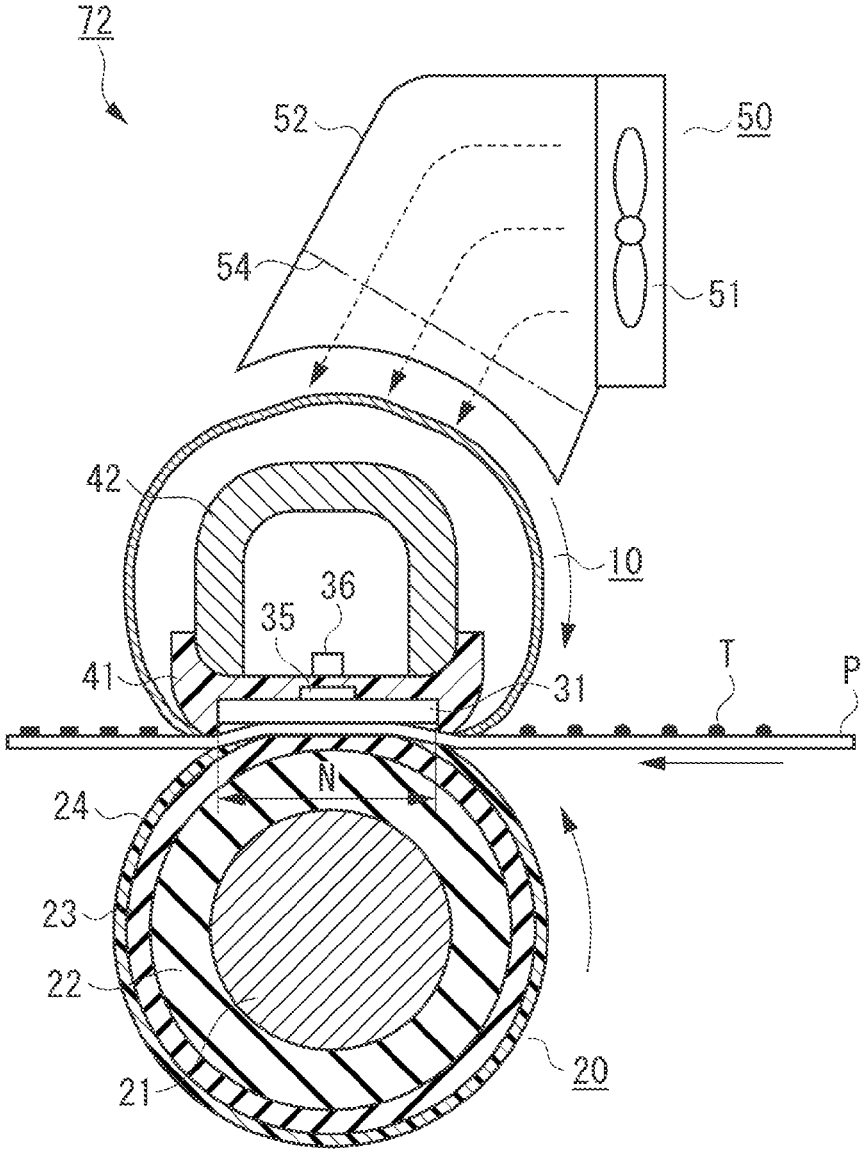
FIG. 1 is a cross-sectional view of a heat fixing device according to a first exemplary embodiment.
Figure 2:
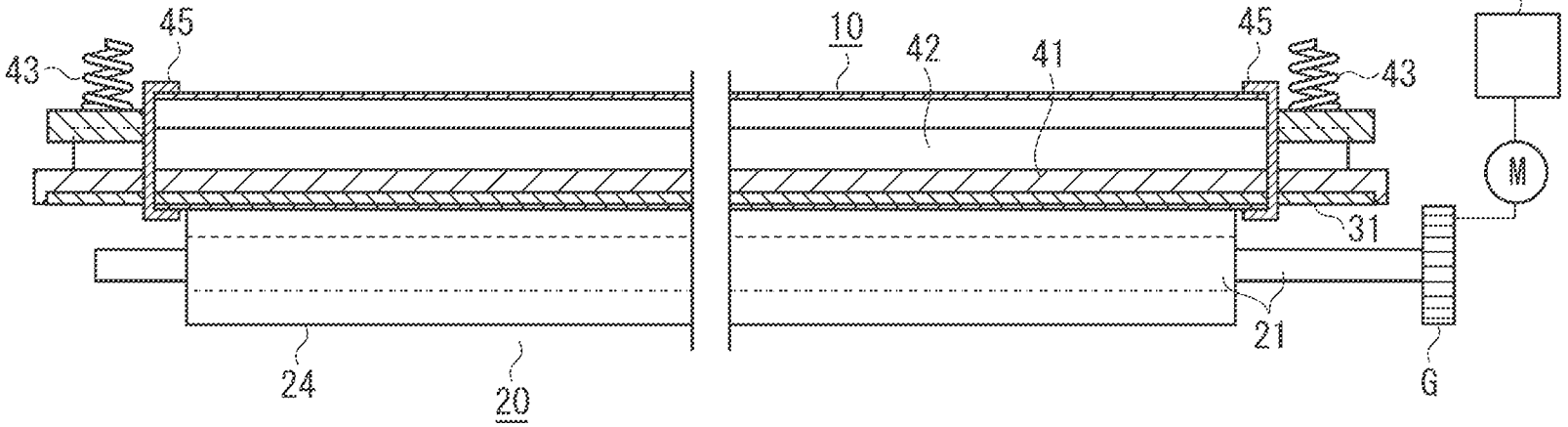
FIG. 2 is a cross-sectional view of the heat fixing device according to the first exemplary embodiment viewed from a paper passing direction.
Figure 3:
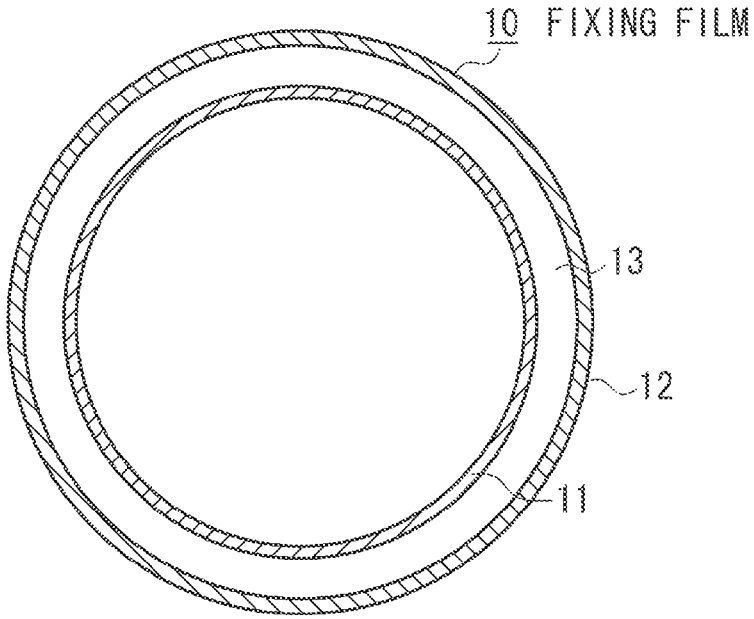
FIG. 3 is a cross-sectional view of a fixing film.
Figure 4:
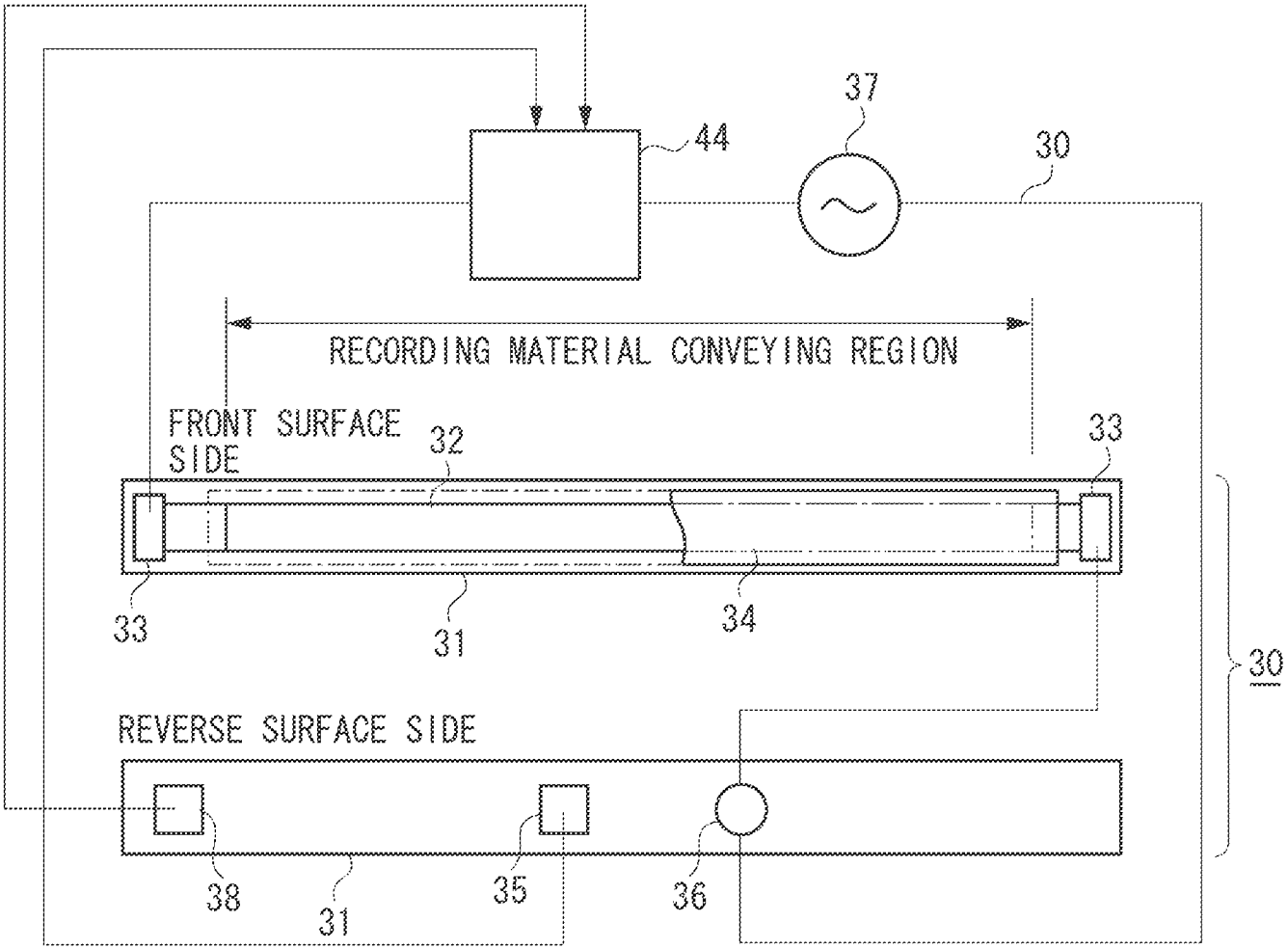
FIG. 4 is a view illustrating a heater and an electric power control circuit to the heater.
Figure 8:
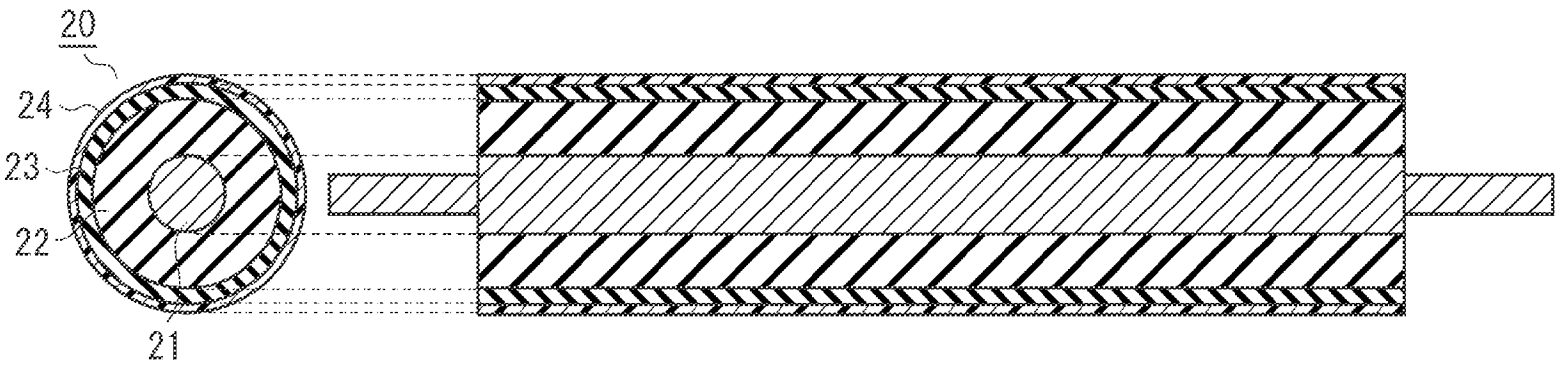
FIG. 8 is a cross-sectional view of a pressing roller according to the first exemplary embodiment.

FIG. 1 is a cross-sectional view of a heat fixing device 72 that fixes an unfixed toner image formed on the recording material onto the recording material, according to a first exemplary embodiment. FIG. 2 is a cross-sectional view of the heat fixing device 72 in FIG. 1 viewed from a paper feeding direction. FIG. 3 is a cross-sectional view of a fixing film 10. FIG. 4 is a view illustrating a heater 30 and an electric power control circuit to the heater. FIG. 8 is a layer configuration diagram of a pressing roller 20. The heat fixing device 72 is described below using FIGS. 1 to 4 and FIG. 8.

The heat fixing device 72 is a pressing roller-driven device in which the pressing roller 20 is rotated and driven to rotate the fixing film 10 with a conveying force of the pressing roller 20. The heat fixing device 72 includes a heater 30, a cylindrical fixing film 10 as a rotatable member for heating, a heater holder 41 made from a heat resistant resin, a pressing stay 42 made from a metal, a pressing spring 43 applying a pressure to a fixing nip portion N, and a flange 45 that is a restricting member that restricts a movement closer to a lengthwise direction of the fixing film.

The fixing film 10 includes a base layer 11 formed from a material having heat resistance and flexibility into an endless shape, and a release layer 12 provided on an outer periphery of the base layer 11. To enhance the fixability and an image quality, an elastic layer 13 such as silicone rubber may be provided between the base layer 11 and the release layer 12. As a material as the base layer 11, a thin-walled metal such as SUS (stainless) and Ni having a high heat conductivity may be used in addition to the heat resistant resin such as polyimide, polyamideimide, and PEEK (polyetheretherketone).

The release layer is one obtained by being coated with a fluorine resin such as PFA, PTFE or FEP alone or in mixture or one obtained by being covered with a fluorine resin tube. PFA is tetrafluoroethylene-perfluoroalkyl vinyl ether copolymer, PTFE is polytetrafluoroethylene, and PEP is tetrafluoroethylene-hexafluoropropylene copolymer.

The thickness of the release layer 12 is required to be 5 μm or more in terms of durability. When the release layer 12 is too thick, the heat conductivity is reduced to harmfully affect the fixability. Thus, its thickness is required to be 50 μm or less. To strike a good balance between the durability and the fixability as described above, the thickness of the release layer 12 is desirably 5 μm or more and 50 μm or less.

If the elastic layer 13 is provided between the outer periphery of the base layer 11 and the inner periphery of the release layer 12, the heat can be evenly given by wrapping an unfixed toner image T carried by the recording material P. Thus, the fixing film 10 can track an unevenness formed by the recording material P and the toner image T, reduce roughness on a halftone image, and obtain the uniform and sufficient fixability. The thicker the thickness of the elastic layer 13 is, more efficiently the fixing film 10 can wrap the toner image T carried by the recording material P to heat and fix the toner image T onto the recording material P. More specifically, the thicker the thickness of the elastic layer 13 is, more efficiently the effect of wrapping the unfixed toner image T can be enhanced. However, when the thickness of the elastic layer 13 is too thick, a heat capacity is excessively increased. Thus, start-up of the fixing film 10 is delayed, and an on-demand property inherent to a film heating system is reduced. Thus, the thickness of the elastic layer 13 is to be 50 μm or more and 500 μm or less. The higher the heat conductivity of the elastic layer 13 is, the more desirable it is, and it is desirably 0.5 W/m·K or more. The heat conductivity is adjusted by mixing a heat conductive filler such as ZnO, $Al_2O_3$, SiC, and metal silicon in silicone rubber so as to accomplish such a heat conductivity.

In the fixing film 10, it is more desirable that an outer diameter of the fixing film 10 be smaller because the heat capacity is reduced. However, if the outer diameter is too small, the width of the nip portion N becomes narrow, and thus the outer diameter cannot be reduced extremely. Therefore, in the fixing film 10 of the present exemplary embodiment, SUS is used for the material of the base layer 11, a wall thickness (thickness) of the base layer 11 is 30 μm, and an inner diameter of the base layer 11 is 24 mm in consideration of conditions such as speed (process speed) in an image forming apparatus. The silicone rubber having the heat conductivity of 1.3 W/m·K is used for the elastic layer 13, the thickness of which is 250 μm. A coating with PFA is used for the release layer 12, and the thickness of the release layer 12 is 14 μm.

The heater holder 41 is formed from the heat resistant resin such as a liquid crystal polymer, a phenol resin, polyphenylenesulfide (PPS), and PEEK. The lower the heat conductivity of the heat holder 41 is, the higher a heat efficiency is when an inner surface of the fixing film 10 is heated by the heater 30. Thus, a hollow filler such as a glass balloon or a silica balloon may be enclosed in the heat resistant resin that forms the heater holder 41. An under surface of the heater holder 41 (surface on a side of the pressing roller 20) is provided with a concave groove along the lengthwise direction of the heater holder 41. A base plate 31 of the heater 30 is held by the concave groove so that a protection sliding layer 34 of the heater 30 described below is exposed from the concave groove. The fixing film 10 is loosely fitted onto an outer circumference of the heater holder 41. Both edges in the lengthwise direction of the heater holder 41, onto which the fixing film 10 is fitted, is held by an apparatus frame (not shown).

The pressing roller 20 includes a core shaft portion 21, a solid rubber elastic layer 22 provided on the outer periphery of the core shaft portion 21, a highly heat conductive rubber layer 23 provided on the outer periphery of the solid rubber elastic layer 22, and a release layer 24 provided on the outer periphery of the highly heat conductive rubber layer 23. Details thereof are described below.

FIG. 4 is a schematic view illustrating a constitution of an example of the heater 30. The heater 30 is a platy heating device that rapidly heats the fixing film 10 with contacting with the inner periphery of the fixing film 10 (inner periphery of the base layer 11). The heater 30 has a long and thin base plate 31 in the lengthwise direction. The base plate 31 is an insulative ceramic base plate of alumina or aluminum nitride or a heat resistant resin base plate of polyimide, PPS, or a liquid crystal polymer. An energization heat-generation resistive layer 32 of Ag/Pd (silver palladium), $RuO_2$, or $Ta_2N$ is formed by screen printing or coating in a liner or band-like shape on the surface of the base plate 31 (surface on the side of the pressing roller 20) along the lengthwise direction of the base plate 31. The thickness and the width of the energization heat-generation resistive layer 32 are about 10 μm and about 1 to 5 mm, respectively. On the surface of the base plate 31, an inside of the both edges of the base plate 31 in the lengthwise direction is provided with a power feeding electrode 33 for feeding power to the energization heat-generation resistive layer 32. The surface of the base plate 31 may be provided with the protection sliding layer 34 for protecting the energization heat-generation resistive layer 32 insofar as the heat efficiency of the energization heat-generation resistive layer 32 is not impaired. However, it is desirable that the thickness of the protection sliding layer 34 is thin enough to make a surface property of the energization heat-generation resistive layer 32 good. Heat resistant resins such as polyimide and polyamideimide, and glass coating, and the like are used as the protection sliding layer 34. When aluminum nitride and the like having the good heat conductivity are used as the base plate 31, the energization heat-generation resistive layer 32 may be formed on a backside of the base plate 31 (side opposite to a side facing the pressing roller 20).

The pressing stay 42 is formed from a metal material having a rigidity into a U-shape downward to a cross-section. The pressing stay 42 is arranged in a crosswise direction center above the heater holder 41 (side opposite to the pressing roller 20) inside the fixing film 10. Both edges of the pressing stay 42 in the lengthwise direction are biased toward an axis line of the pressing roller 20 by a pressing unit 43 such as a pressing spring through the fixing flange 45 held by the apparatus frame. This presses the surface of the base plate 31 in the heater 30 to the surface of the pressing roller 20 through the fixing film 10 to elastically deform the elastic layer 22 of the pressing roller 20 along the base plate 31. This forms the nip portion (fixing nip portion) N having a predetermined width required for heating and fixing the toner image T between the surface of the pressing roller 20 and the surface of the fixing film 10.

A control unit 44 performs a predetermined rotation drive control sequence depending on a printing command, and drives a motor M, which is a driving source, to rotate a drive gear G provided in a lengthwise direction edge of the core shaft portion 21 of the pressing roller 20. This rotates the pressing roller 20 in an arrow direction at a predetermined circumferential speed (process speed). At that time, a rotation force that rotates reversely to a rotation direction of the pressing roller 20 acts upon the fixing film 10 by a friction force between the surface of the pressing roller 20 and the surface of the fixing film 10 in the nip portion N. This rotates the fixing film 10 in an arrow direction in the outer circumference of the heater holder 41 at approximately the same circumferential speed as that of the pressing roller 20 as the inner surface of the fixing film 10 is in contact with the protection sliding layer 34 of the heater 30.

Also, the control unit 44 performs a predetermined temperature control sequence depending on a printing command, and supplies electric power from a power source 37 to the heat-generation resistive layer 32 through the power feeding electrode 33 of the heater 30. The heat-generation resistive layer 32 is heated by the power supply, and the temperature of the heater 30 is rapidly elevated to heat the fixing film 10. The temperature of the heater 30 is detected by a main thermistor 35 as a first temperature detection element provided on the backside of the base plate 31, and the main thermistor 35 outputs a temperature detection signal for the heater 30 to the control unit 44. The main thermistor 35 is arranged in a region through which the recording material P in various sizes available for the printer certainly passes in a recording material conveying region in the nip portion N in the lengthwise direction of the heater 30.

A sub thermistor 38 is a second temperature detection element. Actions of the sub thermistor and a cooling fan will be described below. The first temperature detection element 35 detects the temperature of the fixing device (rotatable member for heating or heater) in the region through which the standard recording material having the minimum width available in the apparatus passes. The second temperature detection element 38 detects the temperature of the fixing device (rotatable member for heating or heater) in the region through which the standard recording material having the maximum width available in the apparatus passes and the recording material having the minimum width does not pass (i.e., paper non-passing region).

The control unit 44 receives the temperature detection signal from the main thermistor 35, and controls the power supply to the heat-generation resistive layer 32 so that the heater 30 keeps a predetermined temperature-control temperature (target temperature) based on the temperature detection signal. More specifically, the control unit 44 appropriately controls the electric power supplied to the heat-generation resistive layer 32 so that the heater 30 keeps the predetermined temperature-control temperature based on the temperature detection signal from the main thermistor 35.

A thermo-protector 36 such as a thermo-switch and a temperature fuse is arranged on the backside of the base plate 31 in the heater 30. An input terminal (not shown) of the thermo-protector 36 is series-connected to the power source 37, and an output terminal thereof (not shown) is series-connected to the heat-generation resistive layer 32 in the heater 30. Thereby, even when the heater 30 goes out of control due to a breakdown of the temperature detection element 35, the thermo-protector 36 starts up due to an abnormal temperature elevation of the heater 30, and shuts down the power supply to the heat-generation resistive layer 32.

A recording material P carrying the unfixed toner image T is introduced into the recording material conveying region in the nip portion N in a state in which the rotation of the pressing roller 20 and the fixing film 10 is stable and the temperature of the heater 30 is kept at the predetermined temperature-control temperature. The recording material P is nipped and conveyed by the surface of the fixing film 10 and the surface of the pressing roller 20 at the nip portion N. During the conveying process, the heat of the fixing film 10 heated by the heater 30 and the pressure of the nip portion N are added to the recording material P, and the toner image T is heated and fixed on the surface of the recording material P by the heat and the pressure.

Figure 5A:
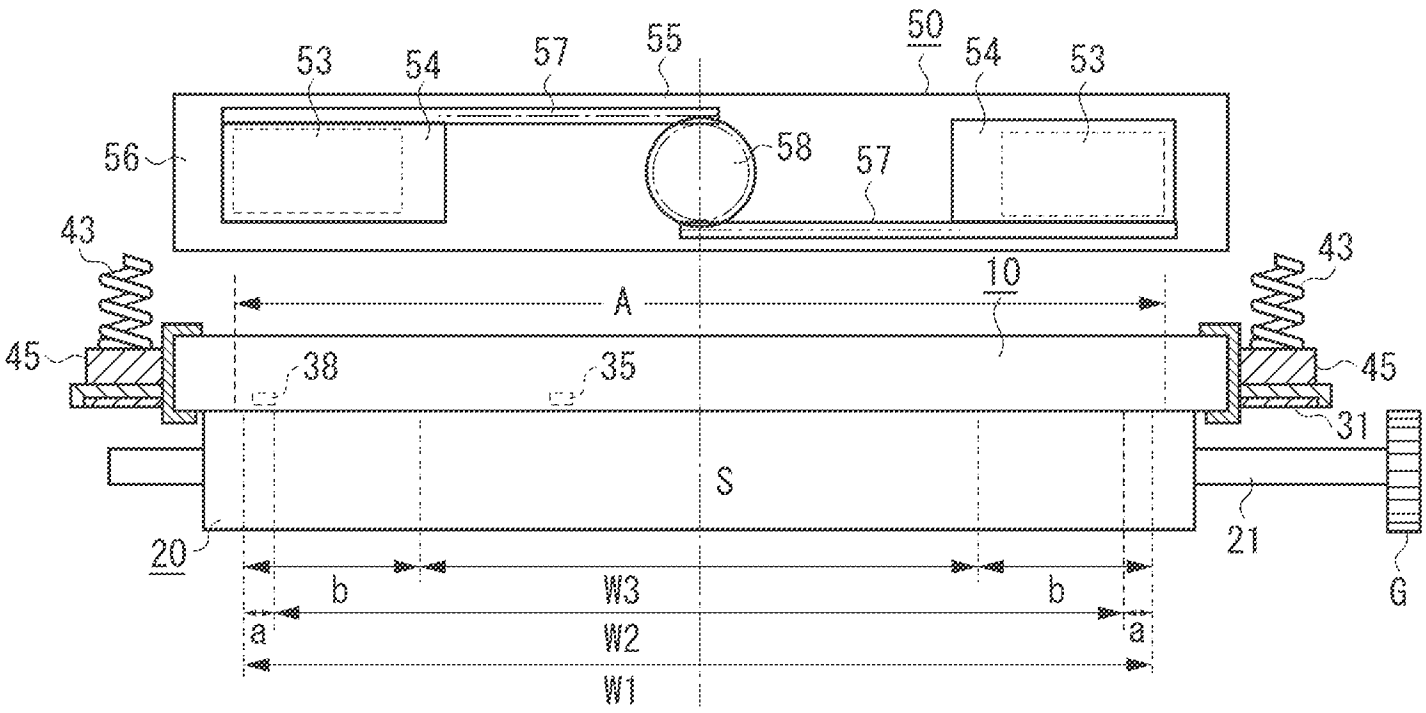
FIGS. 5A and 5B are views of the heat fixing device according to the first exemplary embodiment viewed from an introduction side of a recording material.
Figure 5B:
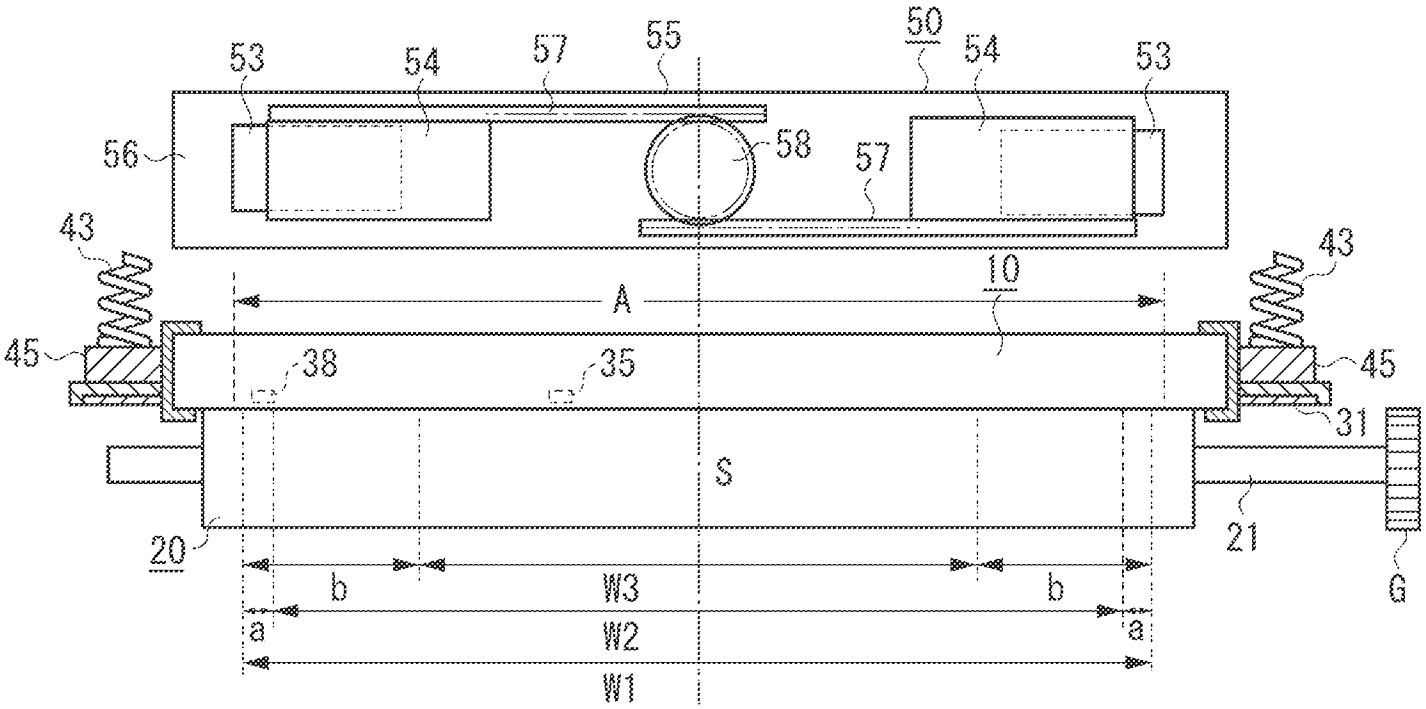
Figure 6A:
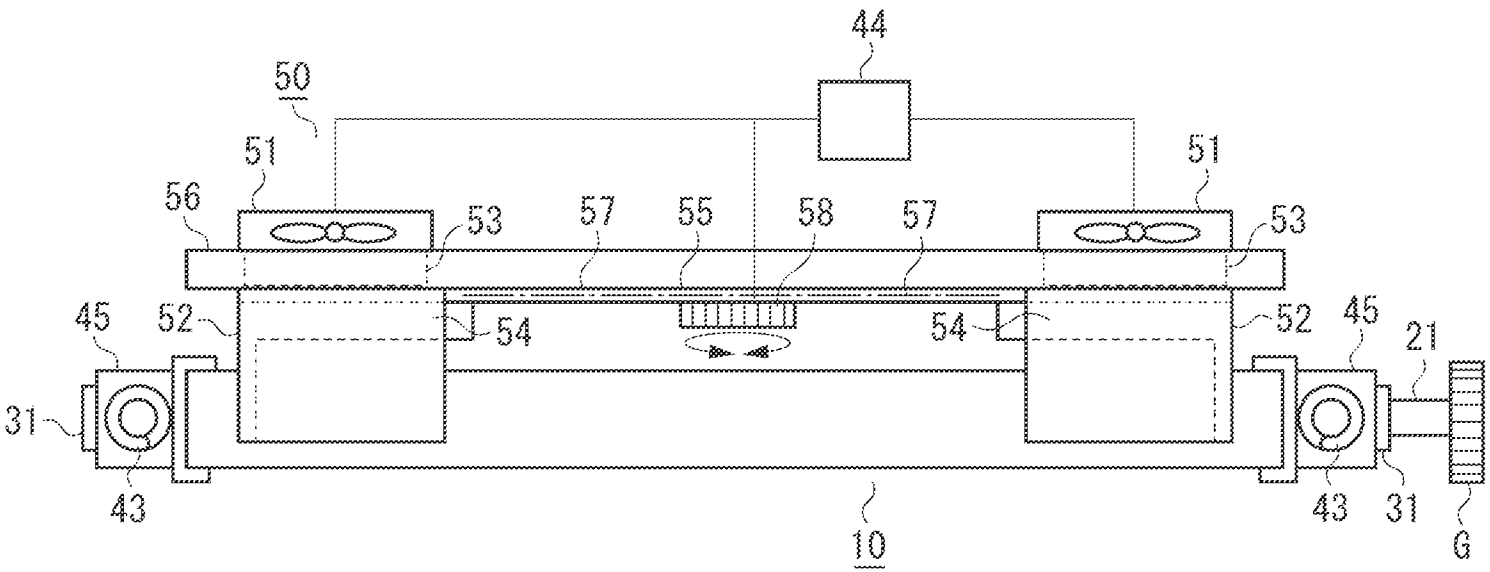
FIGS. 6A and 6B are views of the heat fixing device according to the first exemplary embodiment viewed from above.
Figure 6B:
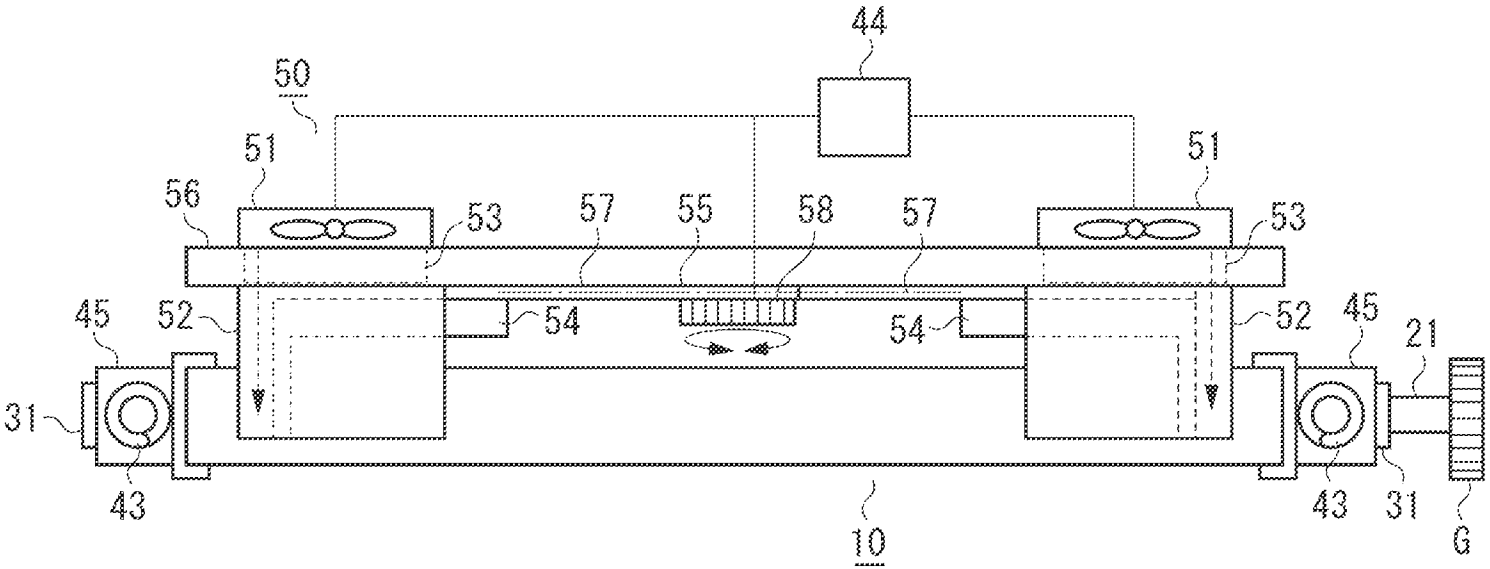

FIGS. 5A and 5B are views illustrating states of the heat fixing device 72, a recording material, and a paper non-passing region (recording material non-passing region). FIGS. 6A and 6B are views illustrating states of the heat foxing device 72 viewed from above.

In the present exemplary embodiment, the recording material is conveyed in a guide center conveying method based on a center of the recording material. More specifically, the center in a width direction of the recording material is to pass through the center in the lengthwise direction of the fixing film 10 concerning any recording materials having any widths available in the apparatus. A recording material center passing standard line (virtual line) is indicated by symbol S.

A width W1 is a width of the recording material having the maximum width available for the apparatus (maximum paper passing width). The maximum paper passing width W1 in the present exemplary embodiment is an A4 landscape size width 297 mm (A4 landscape feed, A3 portrait feed). An effective heating region width A in the lengthwise direction of the heater is slightly larger than the maximum paper passing width W1. More specifically, the heating region in a roller axis direction of the heater is wider than the region through which the standard recording material having the maximum width available for the apparatus passes. A width W3 is a width of the recording material having the minimum width available for the apparatus (minimum paper passing width). The minimum paper passing width W3 in the present exemplary embodiment is a B5 portrait size width 182 mm (B5 portrait feed). A width W2 is a letter size width 279 mm of the recording material between the above maximum width recording material and minimum width recording material (letter landscape feed, ledger portrait feed).

A width "a" is a width remainder portion between the maximum width paper passing width W1 and the paper passing width W2 [(W1-A2)/2], and a width "b" is a width remainder portion between the maximum width paper passing width W1 and the minimum width paper passing width W3 [(W1-W3)/2]. More specifically, these are paper non-passing portions produced when the recording material of LTR landscape or B5 portrait, which is a smaller size recording material, is fed, compared with when the recording material of A4 landscape is fed. The paper non-passing portions "a" and "b" are produced in both right and left edges of the paper passing width W2 and the minimum paper passing width W3, respectively, because the recording material is fed in the guide center conveying in the present exemplary embodiment. The width of this paper non-passing portion varies depending on the size of the recording material usually fed/used and having the small size.

A blower cooling mechanical section 50 is a cooling unit that cools an elevated temperature of the paper non-passing portion in the fixing film 10 by blowing, which is produced when the recording material having the small size is continuously fed (small size job). The blower cooling mechanical section 50 in the present exemplary embodiment is described with reference to FIG. 1 and FIGS. 5A and 5B. The blower cooling mechanical section 50 has a cooling fan 51. The blower cooling mechanical section 50 also has a blower duct 52 that leads the wind produced in the cooling fan 51 and blower vents (opening portion) 53 arranged in opposite to a fixing mechanical section in the blower duct 52. The blower cooling mechanical section 50 also has shutters 54 that open or close the blower vents 53 to adjust an opening width to a width suitable for the width of the recording material P to be fed, and a shutter driving device (an opening width adjusting unit) 55 that drives the shutters 54.

The cooling fan 51, the blower duct 52, the blower vents 53, and the shutters 54 are symmetrically arranged in the lengthwise direction of the fixing film 10. An axial fan may be used, and a centrifugal fan such as Sirocco fan may also be used as the above fan 51.

The right and left shutters 54 are supported slide-movably in a horizontal direction along a surface of a support plate 56 on which the blower vents 53 are formed and which extends in the horizontal direction. The right and left shutters 54 are connected via gear racks 57 and a pinion gear 58, and the pinion gear 58 is normally rotated or reversely rotated by a motor (not shown). This engages the right and left shutters 54 and symmetrically opens or closes the corresponding blower vents 53. The shutter driving device 55 is composed of the above support plate 56, gear racks 57, pinion gear 58, and motor.

The width of the recording material to be fed is input to the control unit 44 based on information such as an input of the size of the recording material to be used by a user and a recording material width automatic detection mechanism (not shown) in a paper feed cassette. The control unit 44 controls the shutter driving device 55 based on the information. More specifically, a predetermined width of the blower vent 53 can be opened by driving the motor to rotate the pinion gear 58 and moving the shutters 54 with the gear racks 57.

When the information for the width of the recording material indicates a large size of an A3 size width, the control unit 44 controls the shutter driving device to move the shutter 54 to a position at which the blower vent 53 is completely closed, as illustrated in FIGS. 5A and 6A. When the information indicates a small size of an LTR landscape width, the shutter 54 is moved to a predetermined position to open the blower vent 53 to an extent corresponding to the width of a letter landscape size, as illustrated in FIGS. 5B and 6B. When the information indicates a small size of a letter portrait feed or a B5 portrait feed, the shutter 54 is moved to a position at which the blower vent 53 is opened to an extent corresponding to the paper non-passing portion of each recording material.

Opening widths of the blower vent by moving the shutter 54 upon the A4 portrait feed and the letter landscape feed are 48.8 mm and 5.3 mm, respectively, in the present exemplary embodiment. The air volume can be controlled in the range of 0.389 $m^3$/minute to 0.034 $m^3$/minute by controlling a rotation frequency of the cooling fan 51 and the movement of the shutter 54 by the control unit 44.

The sub thermistor 38 detects the temperature in the paper non-passing portion. The sub thermistor 38 is arranged so as to detect the temperature of the heater for the paper non-passing portion. The sub thermistor 38 may also be elastically contacted with and arranged at the inner surface of the base layer of a film portion corresponding to the paper non-passing portion.

The control unit 44 drives the fan 51 in the blower cooling mechanical section 50 depending on a temperature Tsub detected by the sub thermistor 38. A fan driving temperature Tfan-on at which the fan 51 is driven is set every recording material size so that a maximum value of the temperature in the paper non-passing region is equal to or lower than an upper limit temperature for using the fixing film because a temperature distribution in the paper non-passing region is different depending on the recording material size. If the device continues to be used at temperature above the upper limit for the use, deterioration of the elastic layer 12 and the release layer 13 in the fixing film 10 is facilitated due to the heat, and a durable lifetime of the fixing film 10 is shortened.

A signal for shutter control based on the recording material width W is sent to the shutter driving device 55, and the motor is driven to move the shutter 54 to the position corresponding to the recording material width W. More specifically, by opening the blower vent opposite to the paper non-passing region, the cooled wind produced by the fan 51 is sent to the paper non-passing region in the heat fixing device 72. The temperature in the paper non-passing region is lowered by receiving the cooled wind.

The fan 51 is controlled depending on the temperature Tsub detected by the sub thermistor 38. More specifically, drive of the fan is started when the temperature Tsub detected by the sub thermistor 38 exceeds a fan driving temperature Tfan-on (equal to or higher than a cooling action starting temperature). When the temperature Tsub detected by the sub thermistor 38 is lowered by the cooled wind and becomes equal to or lower than a fan stopping temperature Tfan-off (equal to or lower than a cooling action stopping temperature), the drive of the fan is stopped. Tfan-off is set at 10° C. lower than Tfan-on in the present exemplary embodiment.

Figure 7:
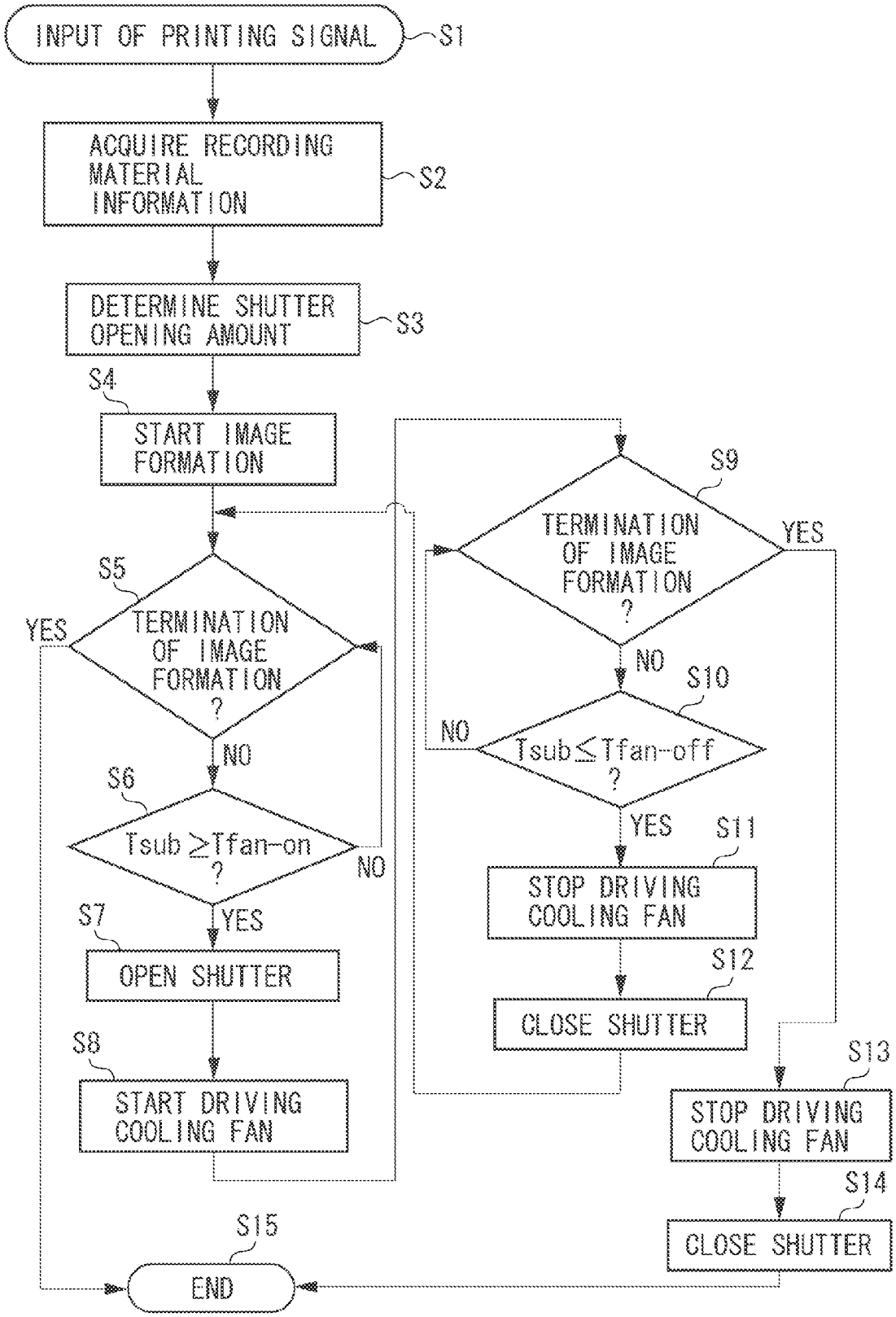
FIG. 7 is a flowchart upon forming an image according to the first exemplary embodiment.

An action upon an elevated temperature in the paper non-passing portion when the recording material is continuously fed is described with reference to FIG. 7. When a printing signal is received (step S1), a shutter opening amount is determined (step S3) by information for a recording material width (step S2) in the printing signal. An energization to the heater 31 is started, and an action to elevate the temperature in the heat fixing device 72 is started. When the temperature in the heat fixing device 72 reaches a predetermined temperature, temperature control and printing action are started so that the temperature of the main thermistor 35 becomes a predetermined fixing temperature (step S4).

When the printing is continued (step S5), if the temperature Tsub of the sub thermistor becomes equal to or higher than the fan driving temperature Tfan-on (step S6), the shutter 54 moves depending on the width of the recording material (step S7) to open the blower vent 53 (step S8). Then, the paper non-passing region is cooled with the cooled wind from the fan 51. When the temperature Tsub detected by the sub thermistor 38 becomes equal to or lower than the fan stopping temperature Tfan-off (step S10), the drive of the fan is stopped (step S11), and the shutter 54 is moved to a completely closed position (step S12). Subsequently, when the temperature Tsub detected by the sub thermistor 38 exceeds again the fan driving temperature Tfan-on (step S6), the shutter 54 is moved (step S7) to cool the paper non-passing region with the cooled wind from the fan 51 (step S8). When the image formation is terminated during the drive of the fan (step S9), the fan 51 is stopped (step S13), the shutter 54 is moved to the completely closed position (step S14), and the printing is terminated (step S15).

Subsequently, concerning the pressing roller 20, materials that compose the pressing roller 20, methods of molding the pressing roller 20, and the like are described below in detail. FIG. 8 is a schematic view illustrating a layer configuration of the pressing roller 20. The layer configuration of the pressing roller 20 includes at least a solid rubber elastic layer (solid rubber layer) 22, as a first elastic layer, and an elastic layer (rubber layer) 23 having a higher heat conductivity than that of the solid rubber elastic layer 22, as a second elastic layer, on an outer circumference of a cored bar 21 of a round shank. Hereinafter, the elastic layer 23 containing a heat conductive filler is referred to as a highly heat conductive elastic rubber layer. The pressing roller 20 also includes a release layer 24 on an outer circumference of the highly heat conductive elastic rubber layer 23. More specifically, in the layer configuration of the pressing roller 20, the solid rubber elastic layer (heat resistant rubber layer) 22, the highly heat conductive elastic rubber layer (elastic layer containing the filler) 23, and the release layer 24 are laminated in this order on the outer circumference of the cored bar 21 of the round shank.

The solid rubber elastic layer 22 is made from a flexible and heat resistant material typified by silicone rubber. The heat conductivity of the solid rubber elastic layer 22 is lower than that of the highly heat conductive elastic rubber layer 23 containing the filler, as described above.

The highly heat conductive elastic rubber layer 23 is formed on the outer circumference of the solid rubber elastic layer 22. The highly heat conductive elastic rubber layer 23 is composed by containing a heat conductive filler in the rubber composed of the flexible and heat resistant material typified by silicone rubber.

The release layer 24 is formed on the outer circumference of the highly heat conductive elastic rubber layer 23. More specifically, the pressing roller 20 has the release layer in an outmost layer (uppermost layer) of the pressing roller 20. The release layer 24 is composed of a material that is typified by a fluorine resin or a fluorine rubber and is suitable for the surface of the pressing roller 20.

The thickness of the entire elastic layer obtained by adding the thickness of the solid rubber elastic layer 22 and the thickness of the highly heat conductive elastic rubber layer 23 used for the pressing roller 20 is not particularly limited as long as the nip portion N having the desired width can be formed, and is desirably 2 to 10 mm. Of those, the thickness of the solid rubber elastic layer 22 is not particularly limited, and may be adjusted appropriately depending on the hardness and the thickness of the highly heat conductive elastic rubber layer 23 described below in detail.

Common heat resistant solid rubber elastic materials such as silicone rubber or fluorine rubber can be used for the solid rubber elastic layer 22. Both materials have the sufficient heat resistance, durability, and desirable elasticity (softness) when used in the heat fixing device 72. Therefore, the silicone rubber or the fluorine rubber is suitable as the major material of the solid rubber elastic layer 22.

As the silicone rubber, for example, addition reaction type dimethylsilicone rubber obtained by rubber-crosslinking dimethylpolysiloxane by an addition reaction between a vinyl group and a silicon-bound hydrogen group can be exemplified as a representative example. As the fluorine rubber, for example, a binary radical reaction type fluorine rubber obtained by rubber-crosslinking a binary copolymer of vinylidene fluoride and hexafluoropropylene as a base polymer by a radical reaction with peroxide can be exemplified as a representative example. In addition, a ternary radical reaction type fluorine rubber obtained by rubber-crosslinking a ternary copolymer of vinylidene fluoride, hexafluoropropylene, and tetrafluoroethylene as the base polymer by the radical reaction with peroxide can also be exemplified as a representative example.

However, in the pressing roller 20, when a foamable sponge rubber is applied in place of the solid rubber elastic layer 22, this is effective in heat insulation but is inferior in durable performance, and thus, it is important to use the solid rubber for the material of the elastic layer 22.

The solid rubber elastic layer 22 referenced herein refers to a layer composed of a rubber polymer alone that is not a layer of a foamable rubber such as the foamable sponge rubber, or a layer composed of the rubber polymer that is not the foamable sponge rubber and an inorganic filler. The heat conductivity A in a roller thickness direction (cross-sectional direction of the pressing roller) of the solid rubber elastic layer 22 that is a non-foamable rubber layer is 0.16 W/(m·k) or more and 0.40 W/(m·k) or less. This heat conductivity was measured using Quick Thermal Conductivity Meter QTM-500 manufactured by Kyoto Electronics manufacturing Co., Ltd. A method of forming the solid rubber elastic layer 22 is not particularly limited, and a common molding can be used suitably.

The highly heat conductive elastic rubber layer 23 is formed by dispersing carbon fibers as the heat conductive filler in a heat resistant elastic material. As the heat resistant elastic material, the heat resistant rubber materials such as silicone rubber and fluorine rubber can be used as is the case with the solid rubber elastic layer 22. When the silicone rubber is used as the heat resistant elastic material, addition type silicone rubber is desirable in terms of easy availability and easy processing. When a viscosity of a raw material rubber before being cured is too low, a liquid dripping occurs upon being processed, and when the viscosity is too high, mixing and separation become difficult. Thus, the viscosity of the raw material rubber is desirably about 0.1 to 1000 Pa·s.

The carbon fiber has a role as the filler for assuring the heat conductivity of the highly heat conductive elastic rubber layer 23. A heat flow path can be formed by dispersing the carbon fiber in the heat resistant elastic material. The carbon fiber has a long and thin fibrous (needle-shaped) shape. Thus, when kneaded with the liquid heat resistant elastic material before being cured, the carbon fiber is easily oriented in a flow direction upon being molded, i.e., in the lengthwise direction of the solid rubber elastic layer 22 (roller axis direction). Thus, the heat conductivity of the highly heat conductive elastic rubber layer 23 can be increased in the lengthwise direction (roller axis direction). This makes a heat flow in the lengthwise direction (roller axis direction) orthogonal to the recording material conveying direction larger than heat flows in other directions. Thus, it becomes possible to efficiently disperse the heat from a high temperature side such as the paper non-passing portion of the heater 31 to a paper passing portion.

The highly heat conductive elastic rubber layer 23 having an approximately uniform thickness is formed on the solid rubber elastic layer 22. When the thickness of the highly heat conductive elastic rubber layer 23 is 0.3 mm or more and more desirably 0.5 mm or more, the heat can migrate more effectively in the lengthwise direction.

Subsequently, the carbon fiber dispersed in the highly heat conductive elastic rubber layer 23 is described in detail. When an average value of a fiber length portion L in the carbon fiber is shorter than 10 μm, a heat conductivity anisotropic effect in the highly heat conductive elastic rubber layer 23 is hard to appear. More specifically, when the heat conductivity is high in the lengthwise direction and low in a circumferential direction in the highly heat conductive elastic rubber layer 23, a heat quantity in the paper non-passing portion can be supplied to a central portion in the nip portion, and thus energy can be saved for obtaining the same fixability. When the average value of the fiber length is longer than 1 mm, it is difficult to disperse, process, and mold the carbon fiber in the highly heat conductive elastic rubber layer 23. Therefore, the length of the carbon fiber is 0.01 mm or more and 1 mm or less, and desirably 0.05 mm or more and 1 mm or less. As such, a carbon fiber, a pitch-based carbon fiber produced using petroleum pitch or coal pitch as a raw material, is desirable in terms of heat conductive performance.

A lower limit of a content of the carbon fiber dispersed in the heat resistant elastic material is 5% by volume, and when the content is less than this, an expected value for the heat conduction is not obtained. An upper limit of the content of the carbon fiber dispersed in the heat resistant elastic material is 40% by volume, and when the content is more than this, processing and molding are difficult, as well as the hardness is increased and an expected value for the hardness is not obtained. More specifically, the heat conductive filler is dispersed in an amount of 5% by volume or more and 40% by volume or less in the highly heat conductive elastic rubber layer 23. Desirably, the heat conductive filler is dispersed in an amount of 15% by volume or more and 40% by volume or less in the highly heat conductive elastic rubber layer 23.

The thickness of the highly heat conductive elastic rubber layer 23 is desirably 0.30 to 5 mm in terms of performance and molding, but can be controlled appropriately depending on the thickness of the solid rubber elastic layer 22, which is an underlayer.

The hardness of the highly heat conductive elastic rubber layer 23 is desirably in a predetermined range of the hardness in terms of assuring the desired nip width. In the present exemplary embodiment, the hardness of the highly heat conductive elastic rubber layer 23 was measured using ASKER Durometer Type C (ASKER-C type hardness meter) manufactured by Kobunshi Keiki Co., Ltd., in accordance with JIS K7312 and SRISO101 standard. The hardness (hereinafter described as ASKER-C hardness) is in the range of 5 to 60 degrees. The desired nip width can be sufficiently assured by putting the ASKER-C hardness of the highly heat conductive elastic rubber layer 23 in this range. In a sample the thickness of which is not enough to measure the ASKER-C hardness, the highly heat conductive elastic rubber layer 23 alone is cut out, a required number of layer pieces are appropriately stacked, and the hardness of the stacked layer pieces is measured. The ASKER-C hardness of the stacked samples to be measured is measured. In the present exemplary embodiment, the thickness of 15 mm was acquired for the sample to be measured, and the ASKER-C hardness thereof was measured.

The heat conductivity in the recording material convey direction (circumferential direction of the roller, hereinafter referred to as an (x) direction) and in a direction orthogonal to the (x) direction (lengthwise direction of the roller (axis direction), hereinafter referred to as a (y) direction) of the highly heat conductive elastic rubber layer 23 can be measured by a hot disc method. TPA-501 manufactured by Kyoto Electronics Manufacturing Co., Ltd. was used as a measurement device for it. The highly heat conductive elastic rubber layer 23 alone is cut out for acquiring the thickness enough to be measured, and the heat conductivity of the sample to be measured obtained by stacking the predetermined number of layer pieces is measured in the (x) direction and the (y) direction.

In the present exemplary embodiment, a piece of (x) direction (15 mm)×(y) direction (15 mm)×thickness (set thickness) is cut out from the highly heat conductive elastic rubber layer 23, and the pieces are stacked so that the thickness is about 15 mm, and used as a sample to be measured. Subsequently, the sample to be measured is infixed with a tape with a width of 10 mm. Subsequently, a front surface to be measured and a reverse surface to be measured are cut using a razor in order to uniform a flatness of the surface to be measured in the sample to be measured. Two sets of the sample to be measured are prepared, and a sensor is sandwiched with two samples to be measured to measure the heat conductivity. When the heat conductivity is measured by changing the direction ((x) direction, (y) direction) in the sample to be measured, the measurement direction is changed and the measurement can be conducted in the method as described above. An average value of five measurements was used in the present exemplary embodiment.

In the highly heat conductive elastic rubber layer 23 in the pressing roller 20 in the present exemplary embodiment, it is desirable that the heat conductivity $\lambda_y$ in the (y) direction (lengthwise direction) be 2.5 W/(m·k) or more ($\lambda_y \geq 2.5$ W/(m·k)) when measured by the above measurement method. More desirably, the heat conductivity $\lambda_y$ in the (y) direction (lengthwise direction) is 10 W/(m·k) or more ($\lambda_y \geq 10$ W/(m·k)).

When the heat conductivity $\lambda_y$ in the (y) direction of the highly heat conductive elastic rubber layer 23 is ≥2.5 W/(m·k), the temperature elevation in the region through which the recording material P does not pass (paper non-passing region) can be reduced sufficiently even upon printing at high speed. Further when the heat conductivity $\lambda_y$ is 10 W/(m·k) or more, the temperature elevation in the region through which the recording material P does not pass can further be reduced.

The release layer 24 may be formed by putting a PFA tube on the highly heat conductive elastic rubber layer 23, or may be formed by coating the highly heat conductive elastic rubber layer with the fluorine resin such as PTFE, PFA, or FEP. The thickness of the release layer 24 is not particularly limited as long as the sufficient release property can be given to the pressing roller 20, and is desirably 20 to 100 μm. Further, a primer layer and an adhesive layer for the purpose of adhesion and energization may be formed between the solid rubber elastic layer 22 and the highly heat conductive elastic rubber layer 23, and between the highly heat conductive elastic rubber layer 23 and the release layer 24.

In the present exemplary embodiment, a cored bar made from iron and having a diameter of ϕ22 mm was used as the cored bar 21, and the silicone rubber having the thickness of 3 mm and the heat conductivity of 0.24 W/(m·k) was used for the solid rubber elastic layer 22. For the highly heat conductive elastic rubber layer 23, carbon-based pitch fiber XN-100-10M (trade name, manufactured by Nippon Graphite Fiber Corporation, average fiber diameter: 9 μm, average fiber length: 100 μm, heat conductivity: 900 W/(m·k)) was used as the carbon fiber, and the one obtained by combining this in a percentage of 20.2% by volume with addition type silicone rubber was used. At that time, $\lambda_y$ was 15.9 W/(m·k)) and $\lambda_x$ was 5.05 W/(m·k)). The thickness of this highly heat conductive elastic rubber layer was 1 mm. As the release layer 24, the highly heat conductive elastic rubber layer was covered with 50 μm of the tube of PFA.

As Comparative Example, a cored bar made from iron and having a diameter of ϕ22 mm was used as the cored bar 21, and the silicone rubber having the thickness of 4 mm and the heat conductivity of 0.35 W/(m·k) was used for the solid rubber elastic layer 22. As the release layer 24, the highly heat conductive elastic rubber layer was covered with 50 μm of the tube of PFA.

Subsequently, performance evaluation is described. The pressing roller in the present exemplary embodiment and the pressing roller in Comparative Example were used, and a laser printer ready for A3 sized paper, in which a printing speed was 50 sheets/minute (letter size landscape) and a pressing roller surface movement speed (circumferential speed) was 235.6 mm/second, was used for the performance evaluation. To compare the performance under the condition in which the temperature elevation in the paper non-passing region was very hard, the surface temperature of the fixing film and the pressing roller was observed when 500 sheets of letter landscape size paper (120 g/mm$^2$) were continuously printed at a rate of 50 sheets/minute in a low temperature and low humidity environment (15° C./10%). While the paper is fed, when the temperature Tsub detected by the sub thermistor exceeds the fan driving temperature Tfan-on, the shutter driving device moves the shutter to the extent corresponding to the width of the paper non-passing region in the letter landscape size paper, and the opening width of the blower vent is adjusted to 5.3 mm. The air volume blown from the opening width at that time is 0.062 m$^3$/minute.

Figure 9A:
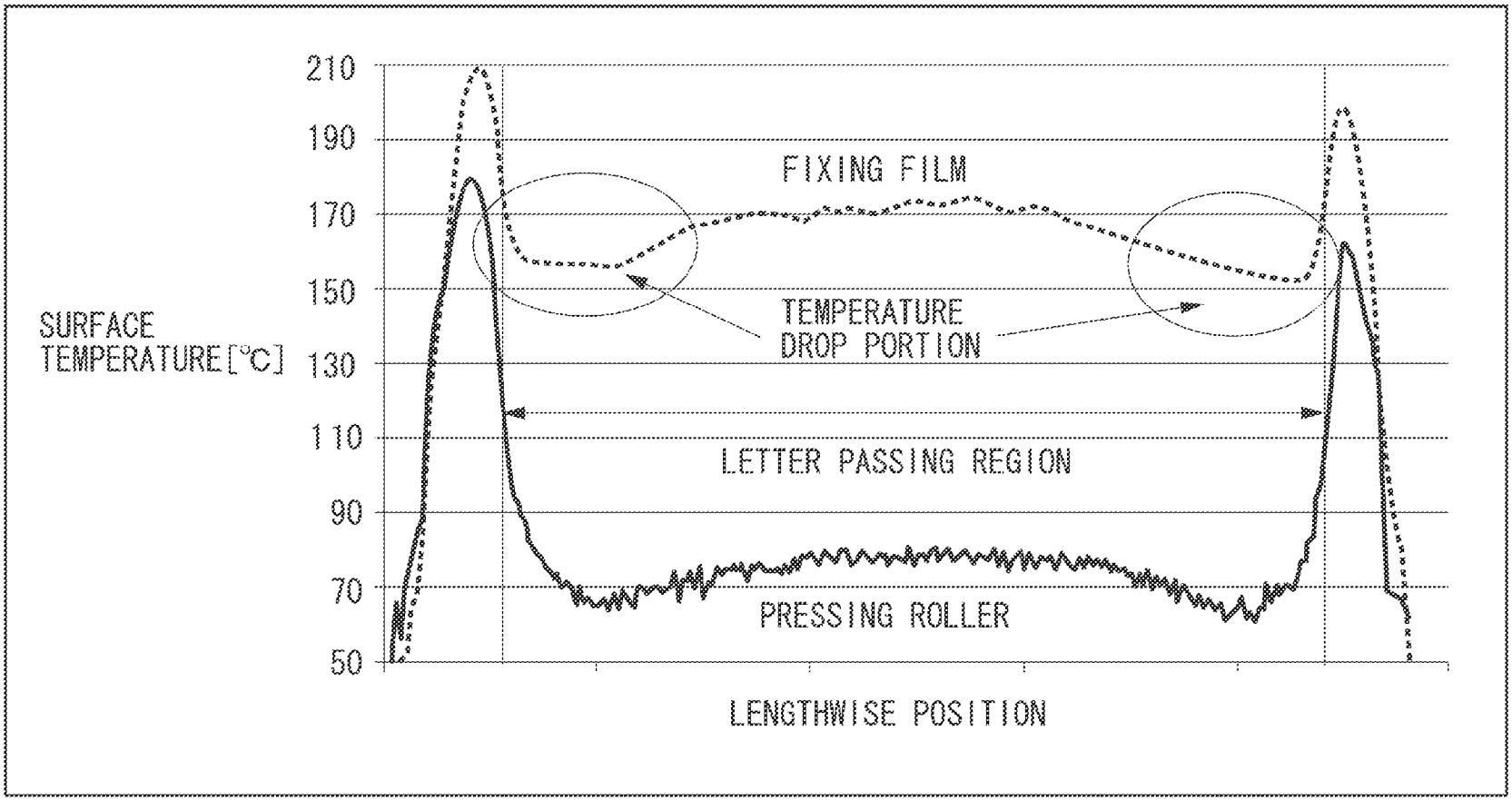
FIGS. 9A and 9B are views illustrating a surface temperature distribution in the fixing film and the pressing roller upon continuous printing according to the first exemplary embodiment and Comparative Example.
Figure 9B:
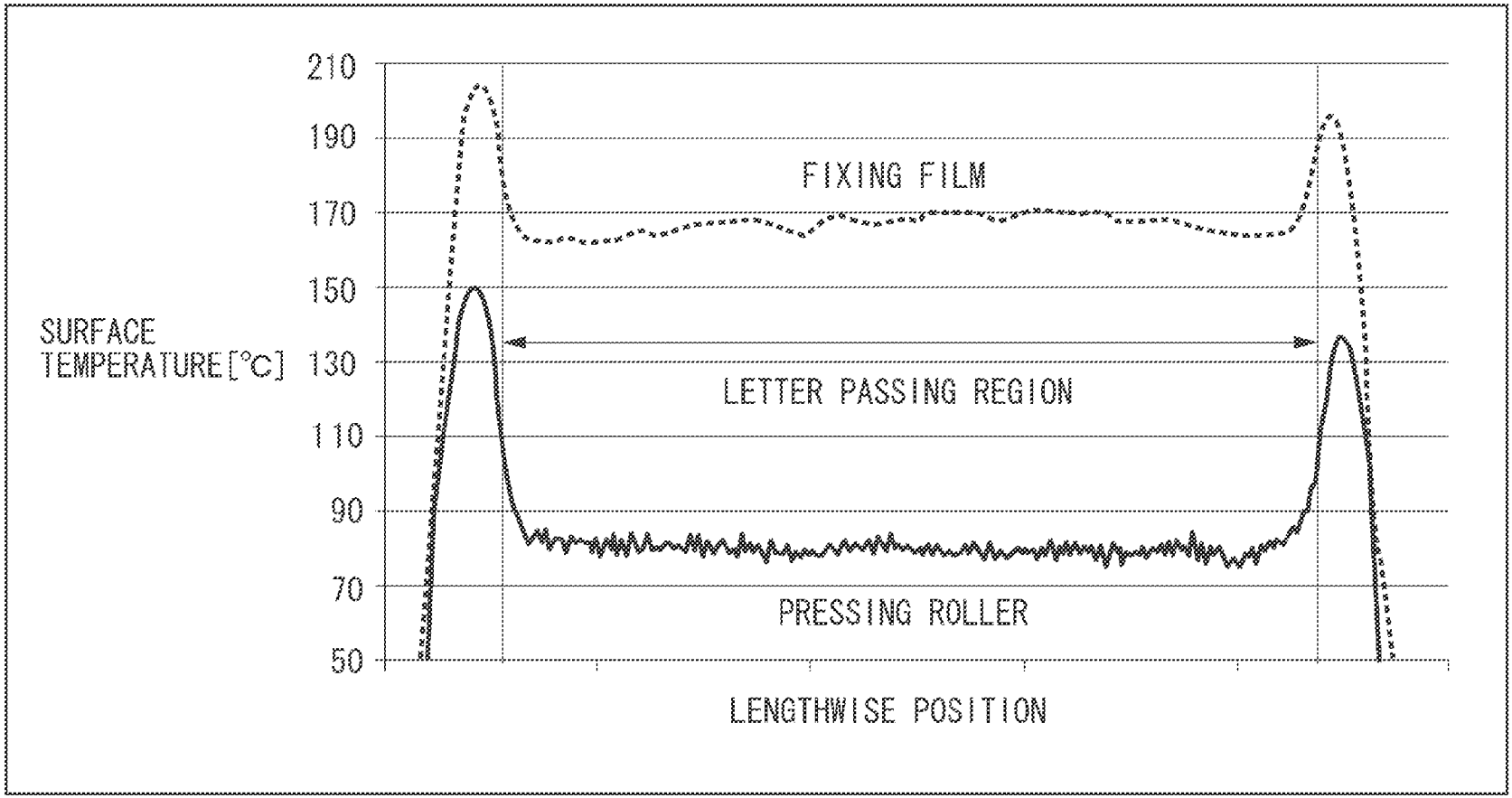

Temperature distributions on a lengthwise surface of the fixing film and the pressing roller when about 500 sheets were printed are illustrated in FIGS. 9A and 9B. As illustrated in FIG. 9A, some wind from the cooling fan enters and cools the edges in the paper passing region of the fixing film in Comparative Example. While continuous printing of 500 sheets was continued, the edges in the paper passing region were gradually cooled, about 20° C. of temperature was dropped compared with the temperature in the central portion of the paper passing region, and fixing failure occurred in the both edges of the recording material. The air volume from the cooling fan was to be reduced for preventing the fixing failure, but the air volume was not able to be reduced because the temperature was elevated closely to an upper temperature limit of the fixing film.

The temperature in the paper non-passing region was also high on the side of the pressing roller, but the temperature in the edges of the paper passing region in the pressing roller was affected by the temperature drop in the fixing film and lowered. Thus, no good balance between the fixability and the reduction of elevated temperature in the edges can be obtained in Comparative Example.

On the other hand in the present exemplary embodiment, as illustrated in FIG. 9B, the temperature in the edges of the paper passing region in the fixing film was scarcely lowered and the fixability was good even at a time point when 500 sheets were fed. The elevated temperature in the paper non-passing region in the pressing roller of the present exemplary embodiment was kept low compared with the pressing roller of Comparative Example, and the temperature in the edges of the paper passing region was not dropped. This is because the pressing roller of the present exemplary embodiment has the highly heat conductive elastic rubber layer in which the heat conductivity in the lengthwise direction is higher than that in the cross-sectional direction just below the surface layer. The heat from the elevated temperature in the paper non-passing region in the pressing roller flows to a low temperature region in the lengthwise direction rather than the cross-sectional direction according to the property of the heat conductivity in the highly heat conductive elastic rubber layer. Thus, the cooled wind also tries to lower the temperature in the edges of the paper passing region of the pressing roller, but the heat from the elevated temperature in the paper non-passing region in the pressing roller continues to be supplied to the portion to be dropped in temperature, and thus the temperature in the paper passing region in the pressing roller is not dropped.

The heat from the elevated temperature in the paper non-passing region in the fixing film also migrates to the portion to be dropped in temperature in the paper passing region through the highly heat conductive elastic rubber layer of the pressing roller. Thus, temperature unevenness in the paper passing region in the fixing film can be reduced to a level with no problem in fixability by transferring the heat so that the lowered temperature in the edges of the paper passing region due to the cooling fan is compensated with the heat from the elevated temperature in the paper non-passing region.

Thus, in the present exemplary embodiment, the temperature unevenness in the paper passing region in the fixing film can be reduced by utilizing the excellent heat conduction in the lengthwise direction of the pressing roller, and thus the performance of the cooling fan can be maximized. This enables striking a good balance between the fixability and the reduction of elevated temperature in the edges.

In a second exemplary embodiment, the layer configuration of the pressing roller is changed for further strengthening the effect of improving the temperature drop in the fixing film. The other configurations are similar to those of the first exemplary embodiment, and thus their description is omitted.

Figure 10:
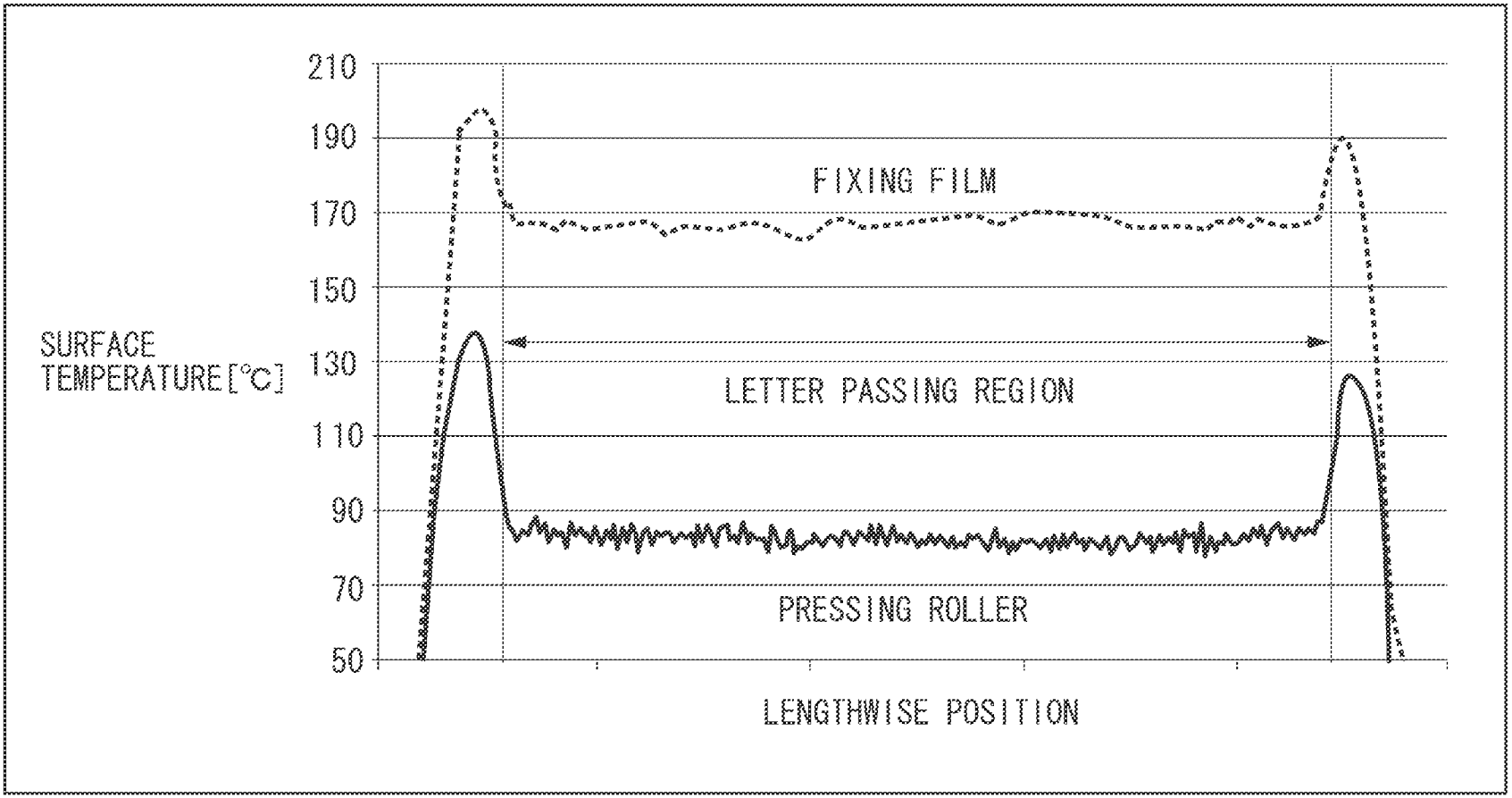
FIG. 10 is a view illustrating a surface temperature distribution in the fixing film and the pressing roller upon continuous printing according to a second exemplary embodiment.

In the pressing roller in the present exemplary embodiment, an outer diameter remains to be ϕ30 mm, and as the elastic layer, the solid rubber elastic layer is removed and the removed thickness is reflected to increase the thickness of the highly heat conductive elastic rubber layer to 4 mm. The highly heat conductive elastic rubber layer has a property that the heat quantity to be transferred in the lengthwise direction is increased depending on its thickness. Thus, increasing the thickness of the highly heat conductive elastic rubber layer makes it easier to run the heat from the elevated temperature in the paper non-passing region to the paper passing region. As a result, as illustrated in FIG. 10, the temperature drop in the edges of the paper passing region in the fixing film was further improved by about 5° C., and the temperature in the paper passing region was able to be made almost uniform. Further, the fixability becomes advantageous because the temperature in the entire paper passing region of the pressing roller is elevated by about 2 to 3° C. Thus, it is possible to strike a good balance between the temperature elevation in the edges and the fixability even in a high-speed printer in which the temperature elevation in the paper non-passing region is hard.

However, the highly heat conductive elastic rubber layer contains the carbon fiber, and thus, is more expensive than the solid rubber elastic layer, thus leading to cost increase. Also, the highly heat conductive elastic rubber layer contains the carbon fiber, and thus, the hardness of the rubber becomes high. Thus, there is a concern that the fixing nip becomes thin to deteriorate the fixability. Therefore, it is necessary to determine, by the balance between the cost and the temperature elevation in the edges/fixability, whether the rubber layer is formed from only the highly heat conductive elastic rubber layer.

In a third exemplary embodiment, in order to effectively transfer the heat from the elevated temperature in the paper non-passing region to the portion to be dropped in temperature, the highly heat conductive elastic rubber layer is formed so that its thickness is thin in the center and thickens toward the edges in the lengthwise direction of the pressing roller. The other configurations are similar to those of the first exemplary embodiment, and thus their description is omitted.

When an image is formed at a higher speed, a speed of elevating the temperature in the paper non-passing region becomes high. Thus, it is necessary to further increase the air volume from the cooling fan. However, if the air volume is increased, the temperature drop in the edges of the paper passing region is increased correspondingly thereto.

When the pressing roller in the first exemplary embodiment is used, the heat from the elevated temperature in the paper non-passing region is transferred to the portion to be dropped in temperature that is lower, while the heat in the paper non-passing region also migrates to the center of the paper passing region, because the thickness of the highly heat conductive elastic rubber layer is uniform in the lengthwise direction. In the case of a printer capable of printing about 50 sheets, the temperature drop in the edges of the paper passing region can be reduced sufficiently as the center in the paper passing region is warmed. However, when a high-speed printer capable of printing more sheets than above is used, it is likely that the temperature drop cannot be improved, thus causing the fixing failure. Thus, in such a high-speed printer, it is necessary to effectively transfer the heat from the elevated temperature in the paper non-passing region to the portion to be dropped in temperature.

In the present exemplary embodiment, the thickness of the highly heat conductive elastic rubber layer is changed in the lengthwise direction, and the thickness is increased from the center toward the both edges. In such a formation, when the recording material having any width is fed, the thickness of the highly heat conductive elastic rubber layer is thicker in the paper non-passing region than in the paper passing region. The heat quantity to be transferred in the lengthwise direction is increased in proportion to the thickness in the highly heat conductive elastic rubber layer. Thus, in the pressing roller in the present exemplary embodiment, the heat in the paper non-passing region can be transferred effectively to the portion to be dropped in temperature by reducing the transfer of the heat from the paper non-passing region to the center in the paper passing region, in which the thickness of the highly heat conductive elastic rubber layer is thin. Thus, even in a high-speed printer, even when the stronger cooling fan is used, the temperature drop can be reduced, and it becomes possible to strike a good balance between the fixability and the elevated temperature in the paper non-passing region.

Figure 11A:
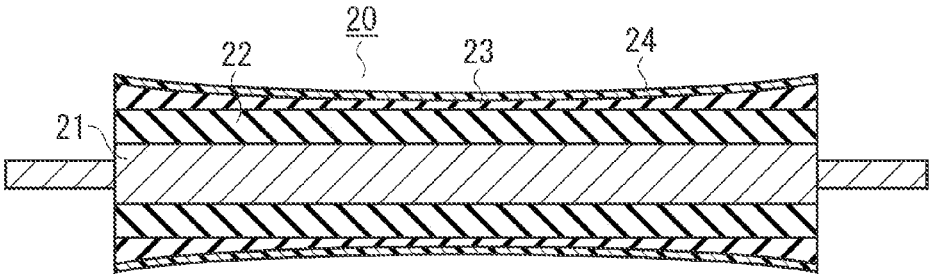
FIGS. 11A, 11B, and 11C are cross-sectional views of the pressing roller according to a third exemplary embodiment.
Figure 11B:
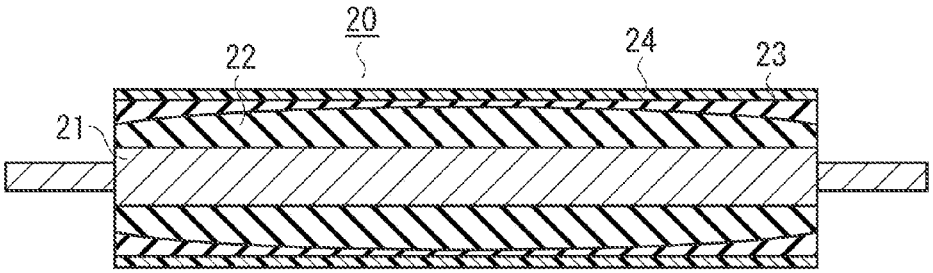
Figure 11C:
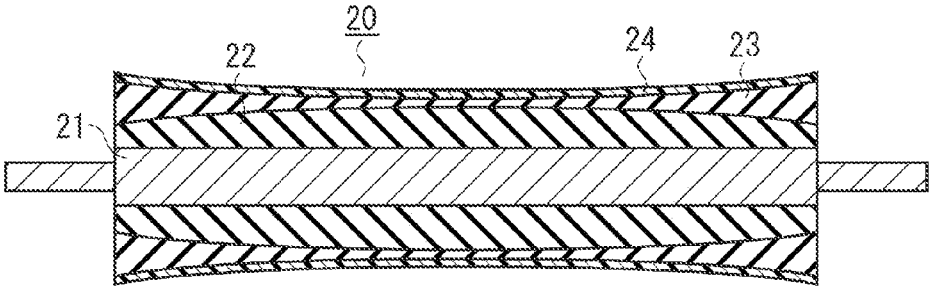

FIGS. 11A, 11B, and 11C are cross-sectional schematic views in the lengthwise direction of the pressing roller in the present exemplary embodiment. In FIG. 11A, the solid rubber elastic layer is formed into a uniform straight shape in the lengthwise direction (i.e., the thickness is uniform over the lengthwise direction), and the highly heat conductive elastic rubber layer is continuously thickened from the center toward the both edges. Thus, the shape of the pressing roller is a reverse crown shape in which thickness is thin in the center and thick in the both edge along the line of the shape of the highly heat conductive elastic rubber layer.

In FIG. 11B, the solid rubber elastic layer is formed to be thick in its center and tapered toward the both edges. The highly heat conductive elastic rubber layer is formed thereon so that the shape of the pressing roller is straight (i.e., the diameter is uniform over the lengthwise direction). Such a configuration can realize the pressing roller, the shape of which remains straight and in which the thickness of the highly heat conductive elastic rubber layer is thin in its center and thick in its both edges.

In FIG. 11C, the thickness of the solid rubber elastic layer is tapered toward the both edges as illustrated in FIG. 11B, but the highly heat conductive elastic rubber layer is formed to be thicker in its both edges than in its center so that the pressing roller is of a reverse crown shape, the both edges of which are thickened. By making such a layer configuration, it becomes possible to change the thickness of the highly heat conductive elastic rubber layer in the lengthwise direction without making the both edges unnecessarily thicker than the center in the pressing roller.

As described above, by changing the thickness of each layer in the length wise direction, it becomes possible to make the both edges thicker than the center in the highly heat conductive elastic rubber layer. However, the shape of the outer diameter of the pressing roller and the thickness of each layer in the lengthwise direction also influence a conveying property of paper and the shape/pressure distribution of the fixing nip. Thus, it is important to determine them in consideration of various situations.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-150906 filed Jul. 7, 2011, which is hereby incorporated by reference herein in its entirety.

What is claimed is:

1. A heat fixing device comprising:

a rotatable member;

a pressing roller configured to form a fixing nip portion that nips and conveys a recording material bearing a toner image, the pressing roller including a core bar and a rubber layer outside the core bar; and a cooling fan configured to blow air to a paper non-passing region of the rotatable member, wherein the rubber layer contains a needle-shaped heat conductive filler oriented in a roller axis direction, and wherein the cooling fan blows air to the paper non-passing region of the rotatable member so that heat quantity flowing, through the rubber layer, from the paper non-passing region of the rotatable member to a paper passing region of the rotatable member is substantially equal to heat quantity removed from the paper passing region by blowing of the cooling fan.

2. The heat fixing device to claim 1, wherein the rubber layer has a heat conductivity of $\lambda_y$ of 2.5 W/(m·k) or more in the roller axis direction.

3. The heat fixing device according to claim 1, wherein the pressing roller further includes a solid rubber layer having a heat conductivity of 0.16 W/(m·k) or more and 0.40 W/(m·k) or less in a roller thickness direction between the rubber layer and the cored bar.

4. The heat fixing device according to claim 3, wherein a total thickness of the rubber layer and the solid rubber layer is 2 to 10 mm.

5. The heat fixing device according to claim 3, wherein a thickness of the solid rubber layer is uniform over the roller axis direction.

6. The heat fixing device according to claim 3, wherein a thickness of the solid rubber layer decreases towards edges of the solid rubber layer in the roller axis direction.

7. The heat fixing device according to claim 4, wherein the rubber layer has a thickness of 0.3 mm or more.

8. The heat fixing device according to claim 1, wherein a thickness of the rubber layer increases from a center of the rubber layer outwards towards both edges of the rubber layer.

9. The heat fixing device according to claim 1, wherein a diameter of the pressing roller increases towards edges of the pressing roller in the roller axis direction.

10. The heat fixing device according to claim 1, wherein the needle-shaped heat conductive filler includes a pitch-based carbon fiber.

11. The heat fixing device according to claim 1, wherein the rotatable member is a tubular film.

12. The heat fixing device according to claim 11, further comprising a heater contacting an inner surface of the tubular film and forming the fixing nip portion with the pressing roller via the film.

* * * * *